US005480091A

United States Patent [19]

Stout

[11] Patent Number: 5,480,091

[45] Date of Patent: Jan. 2, 1996

[54] STRESS-RELIEVING ARRANGEMENT FOR CARTON HANDLES

[75] Inventor: James T. Stout, Ellijay, Ga.

[73] Assignee: The Mead Corporation, Dayton, Ohio

[21] Appl. No.: 439,046

[22] Filed: May 11, 1995

[51] Int. Cl.[6] ..... B65D 5/468

[52] U.S. Cl. ..... 229/117.14; 229/117.13; 229/920

[58] Field of Search ..... 229/117.13, 117.14, 229/920

[56] References Cited

U.S. PATENT DOCUMENTS

| | | | |
|---|---|---|---|
| 2,785,847 | 3/1957 | Forrer | 229/117.13 |
| 2,797,586 | 7/1957 | Jaeschke | 229/117.13 |
| 3,540,581 | 11/1970 | Koolnis | 229/117.13 |
| 3,794,239 | 2/1974 | Bonczyk | 229/117.13 |
| 4,637,515 | 1/1987 | Wilson et al. | 206/434 |
| 4,785,991 | 11/1988 | Schuster | 229/117.13 |
| 4,989,778 | 2/1991 | Saulas | 229/117.13 |
| 5,221,041 | 6/1993 | Stout et al. | 229/117.13 |
| 5,234,102 | 8/1993 | Schuster et al. | 229/117.13 |
| 5,307,932 | 5/1994 | Stout et al. | 229/117.13 |
| 5,333,734 | 8/1994 | Stout et al. | 229/117.13 |
| 5,379,944 | 1/1995 | Stout et al. | 229/117.13 |
| 5,385,234 | 1/1995 | Stout et al. | 229/117.13 |

FOREIGN PATENT DOCUMENTS

| | | |
|---|---|---|
| 1229325 | 11/1987 | Canada . |
| 2522619 | 9/1983 | France . |

*Primary Examiner*—Gary E. Elkins
*Attorney, Agent, or Firm*—Tsugihiko Suzuki

[57] ABSTRACT

A carton for packaging articles includes a generally rectangular top wall having a pair of spaced hand apertures formed therein. The hand apertures are disposed to define therebetween a handle strip for use in lifting the carton. The top wall is provided with a fold line extending from the region of each corner of the top wall toward the handle strip and further with a first severance line extending transversely of each fold line. Each first severance line is interposed between the handle strip and the respective fold line such that each fold line terminates at the respective severance line. This arrangement prevents stress concentration at the region of the handle strip when the carton is lifted.

20 Claims, 5 Drawing Sheets

STRESS-RELIEVING ARRANGEMENT FOR CARTON HANDLES

BACKGROUND OF THE INVENTION

The present invention relates generally to paperboard cartons for use in packaging articles such as cans or bottles for beverages. More particularly, the invention relates to a handle for such cartons which is associated with stress-relieving severance lines.

Articles such as cans or bottles for beverages including soft drink, beer, juices and the like are commonly sold in multiple quantities packaged in a paperboard carton. For the convenience of the consumer, the carton is often provided with a handle, which quite commonly includes as a primary feature one or two slots or other apertures formed in the carton. The user inserts the hand or fingers into one or both of the slots to lift the carton. Many varieties of handles are known in the art.

Lifting a carton containing beverage cans or bottles introduces considerable stress into the paperboard from which the carton is formed. The region around the slot or slots especially tends to be subject to stress concentration. For this reason, to prevent tearing of the paperboard and failure of the carton, it is known to design carton handles with various stress-relieving/distributing arrangements. This is often accomplished by providing fold lines or slits in the carton wall where the handle slots are provided. An example of this type of stress distributing arrangement may be seen in U.S. Pat. No. 5,307,932.

While such conventional arrangements have experienced considerable success, it has still been difficult to eliminate minor cracks and tears from the handle slot area. Minor cracks or tears do not usually result in handle failure. However, consumers may see these as undesirable and not purchase the packages with such cracks or tears.

What is needed, therefore, is a carton having a carrying handle with an improved stress-relieving arrangement. Such a carton should eliminate or reduce tears or fractures and particularly those minor cracks and tears which detract from the carton appearance.

SUMMARY OF THE INVENTION

The present invention, in one aspect, provides a carton which comprises a plurality of carton walls foldably interconnected to form the carton. One of the carton walls having a pair of opposed side edges, a pair of opposed end edges and a hand aperture for use in lifting the carton. Each side edge and either end edge of the one carton wall defines therebetween a corner of the one carton wall. The one carton wall is formed with a severance line disposed transversely of an imaginary line extending between the hand aperture and one of the corners of the one carton wall so as to prevent stress concentration at a region of the hand aperture upon lifting of the carton. The severance line extends from and terminates in the one carton wall such that opposite ends of the severance line are disposed at positions spaced from the side and end edges. Lifting of the carton by holding near the edge of the hand aperture introduces stress into the one carton wall. However, the severance line functions to relieve the hand aperture area from stress, and therefore reduces or even eliminate minor cracks and tears from the carton.

The invention is particularly useful when incorporated into cartons having so called race track handles. In a carton with a race track handle, the one carton wall is provided with a second hand aperture at a position spaced from the first hand aperture such that the first and second apertures define therebetween a handle strip. In this arrangement, the severance line is provided at a position between the handle strip and each corner of the one carton wall.

To distribute stress away from the handle strip area, reinforcing fold lines may be used according to the invention. Such fold lines may be provided to extend from each severance line toward adjacent corner of the one carton wall. A set of fold lines may emanate from each severance line and diverge from each other as they approach the adjacent corner. Alternatively, only one fold line may emanate from each severance line.

The present invention, in another aspect, provides a carton which comprises a generally rectangular top wall having a pair of spaced hand apertures. The hand apertures are disposed to define therebetween a handle strip for use in lifting the carton. The top wall is provided with a fold line extending from a region of each corner of the top wall toward the handle strip and further with a severance line extending transversely of each fold line. Each severance line is interposed between the handle strip and the respective fold line such that each fold line terminates at the respective severance line.

The present invention also provides a blank for forming a carton. The blank comprises a plurality of foldably interconnected wall panels. One of the wall panels is generally rectangular in shape and has a hand apertures formed therein. The one wall panel is provided with a fold line extending from a region of one of the corners of the one wall panel toward the hand aperture and further with a severance line extending transversely of the fold line. The severance line is interposed between the hand aperture and the fold line such that the fold line terminates at the severance line. The one wall panel may be a full size panel for forming an entire top wall of the carton. Alternatively, the one wall panel may be a partial panel for forming a composite top wall of the carton in cooperation with another partial panel.

The objects and advantages of the present invention will be apparent from the following description, the accompanying drawings and the appended claims.

DETAILED DESCRIPTION OF THE PREFERRED EMBODIMENTS

Figure 1:
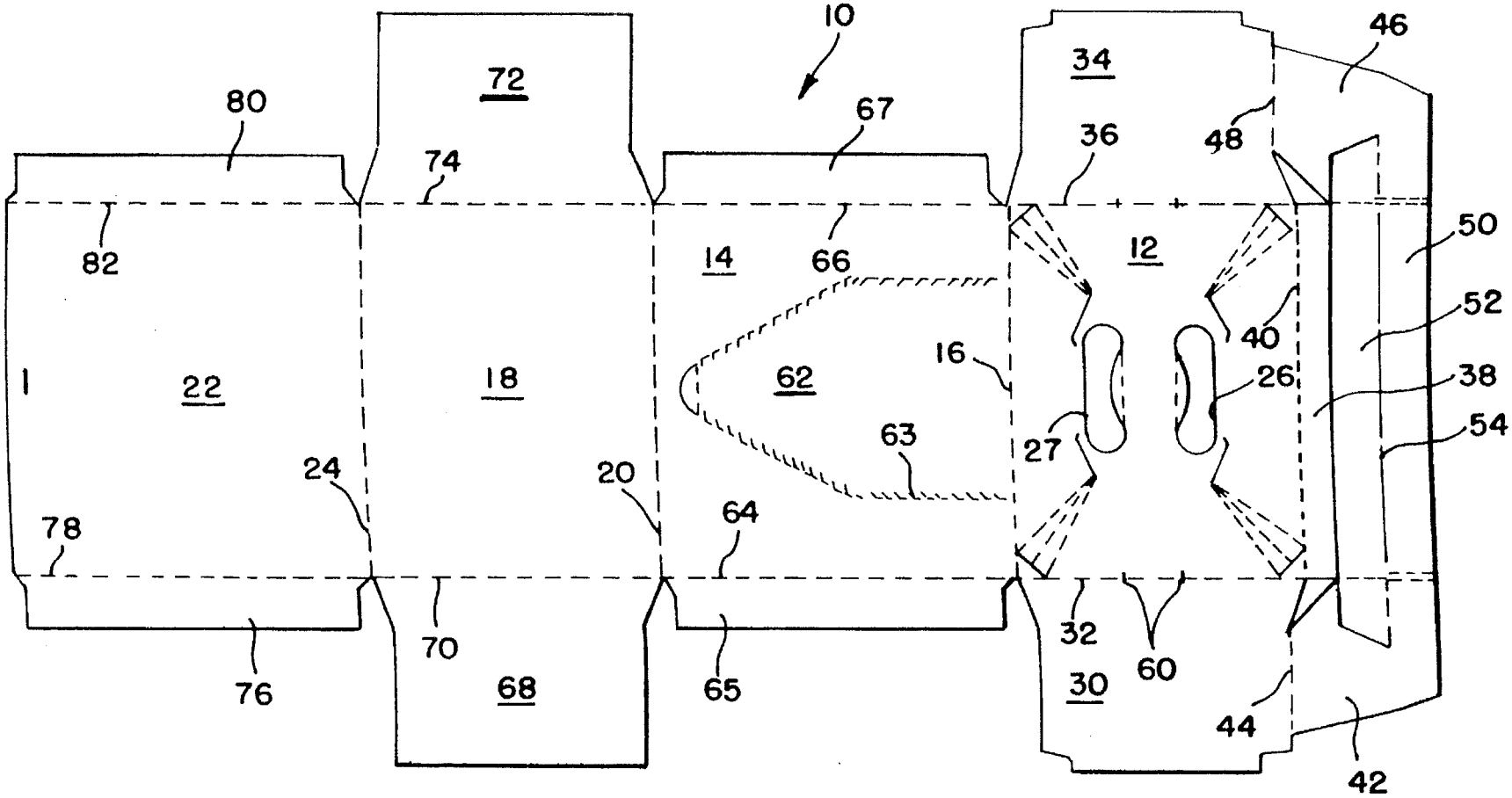
FIG. 1 is a plan view of a blank from which a carton according to the invention is formed.

A carton 10 for use in connection with the present invention may be seen in blank form by reference to FIG. 1 which shows the inside surface of the blank. The carton includes a top wall panel 12 connected to a side wall panel 14 along a fold line 16. A bottom wall panel 18 is connected to the side wall panel 14 along a fold line 20, and at its opposite side to a side wall panel 22 along a fold line 24.

A major end flap 30 is connected at one end edge of the top wall panel 12 along a fold line 32, while a second major end panel 34 is connected at the opposite end of the top wall panel 12 along a fold line 36. A glue flap 38 is connected to the top wall panel 12 along a fold line 40.

A handle reinforcing structure is connected to each of the major end flaps 30 and 34, and comprises an end portion 42 connected to the major end flap 30 along a fold line 44, and an end portion 46 connected to the major end flap 34 along a fold line 48. A central portion 50 interconnects the end portions 42 and 46. An auxiliary handle reinforcing strip 52 is connected to the central portion 50 along a fold line 54. Details of the handle reinforcing structure including torque relief slits 60 may be found by reference to U.S. patent application Ser. No. 08/281,549 and U.S. Pat. No. 5,320,277, which are incorporated herein by reference.

The side wall panel 14 includes a removable access panel 62 defined by a perforated tear line 63. Connected at one end edge of the side wall panel 14 along a fold line 64 is a minor end flap 65, and connected by a fold line 66 at an opposite end edge is a minor end flap 67.

The bottom wall panel 18 has a major end flap 68 connected along a fold line 70 at one end edge thereof, while a second major end flap 72 is connected at an opposite end edge along a fold line 74.

The side wall panel 22 includes a minor end flap 76 connected at one end edge along a fold line 78, and a minor end flap 80 connected along a fold line 82 at the opposite end edge.

Figure 2:
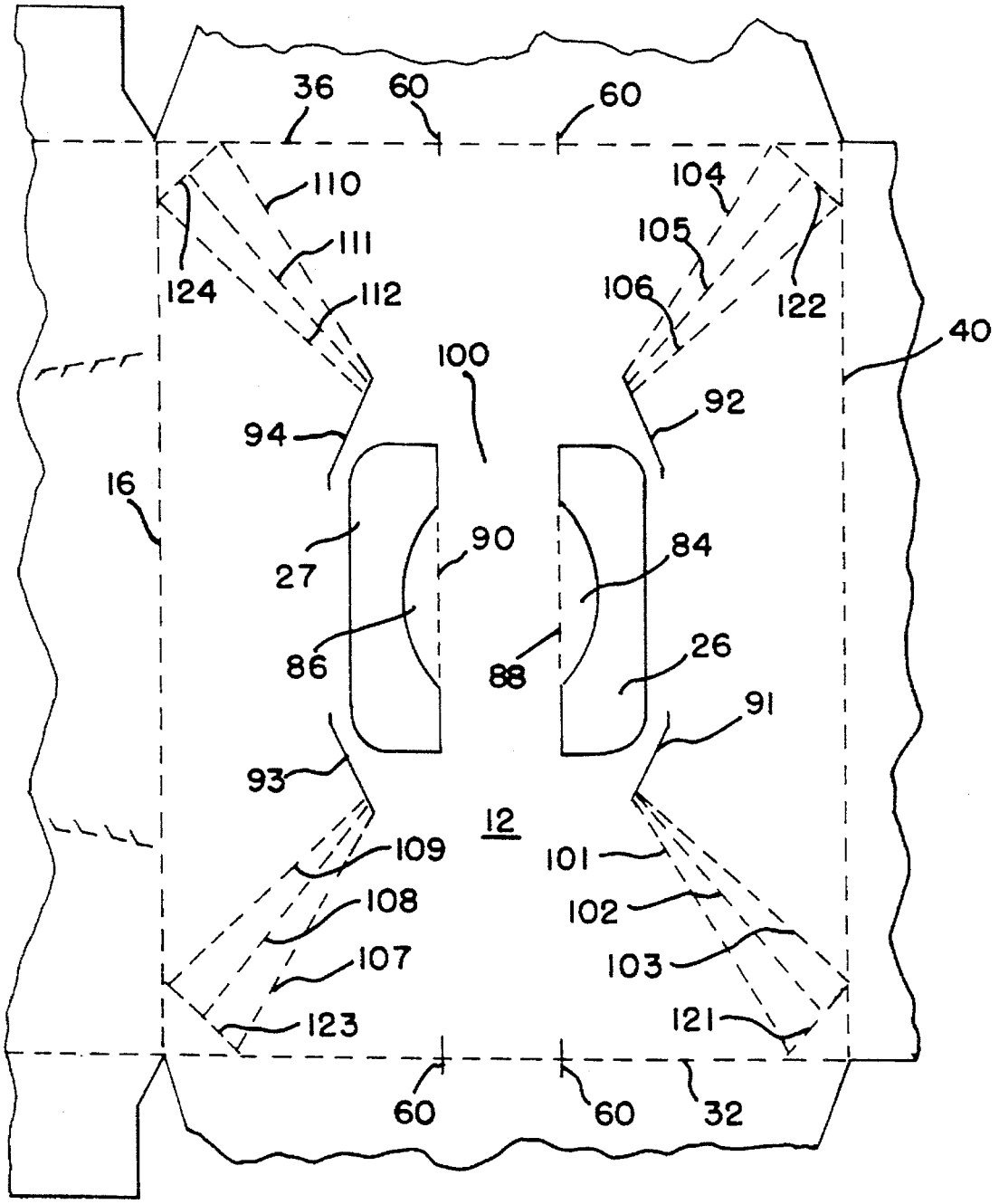
FIG. 2 is an enlarged plan view of the top wall panel in FIG. 1.

As best shown in FIG. 2, the top wall panel 12 includes a pair of transversely spaced elongate hand apertures 26 and 27 for defining therebetween a handle strip 100 which is a portion of the carrying handle of the carton. The handle strip 100 is disposed generally near the center of the top wall panel 12 and extends generally parallel to the side edges 16 and 40 of the top wall panel 12. A pair of cushion flaps 84 and 86 are foldably joined to the handle strip 100 along fold lines 88 and 90 respectively.

The top wall panel 12 further includes four inner severance lines 91–94 and four sets of three reinforcing fold lines 101–103, 104–106, 107–109 and 110–112. The "severance line" in this application refers to a cut, slit, or perforated slit, which is formed in the paperboard material from which the carton is formed and functions to split a part of the paperboard material in two. The "perforated slit" refers to a line consisting of a plurality of short slits aligned/disposed at spacings and ready to split along the line when the carton is lifted by holding the carrying handle.

The inner severance lines 91 and 92 are located adjacent to and spaced from the opposite ends of the hand aperture 26 respectively, and the severance lines 93 and 94 are disposed adjacent to and spaced from the opposite ends of the hand aperture 27. Because the severance lines 91–94 are virtually identical to each other and so do the sets of reinforcing fold lines, only the severance line 91 and the adjacent set of fold lines 101–103 are hereinafter described.

The severance line 91 is disposed obliquely of the top wall panel 12 and transversely of the set of reinforcing fold lines 101–103. The opposite ends of the severance line 91 are disposed at positions spaced inwardly from the side and end edges 40 and 32 of the top wall panel 12. One of the opposite ends, i.e., the straight end, is positioned closer to the end edge 32 than the other end, i.e., the curved end. The set of fold lines 101–103 extend from the straight end of the severance line 91 and diverge from each other toward the adjacent corner of the top wall panel 12. The curved end of the severance line 91 is directed toward the severance line 92 or the end edge 36 of the top wall panel 12.

The fold lines 101–103 terminate at a location spaced inwardly from the adjacent corner of the top wall panel 12. More specifically, the fold lines 101–103 terminate at an outer severance line 121 extending diagonally between the adjacent side edge 40 and the adjacent end edge 32. Reference numeral 122–124 in FIG. 2 also denote outer severance lines which are virtually identical to the outer severance line 121.

Figure 3:
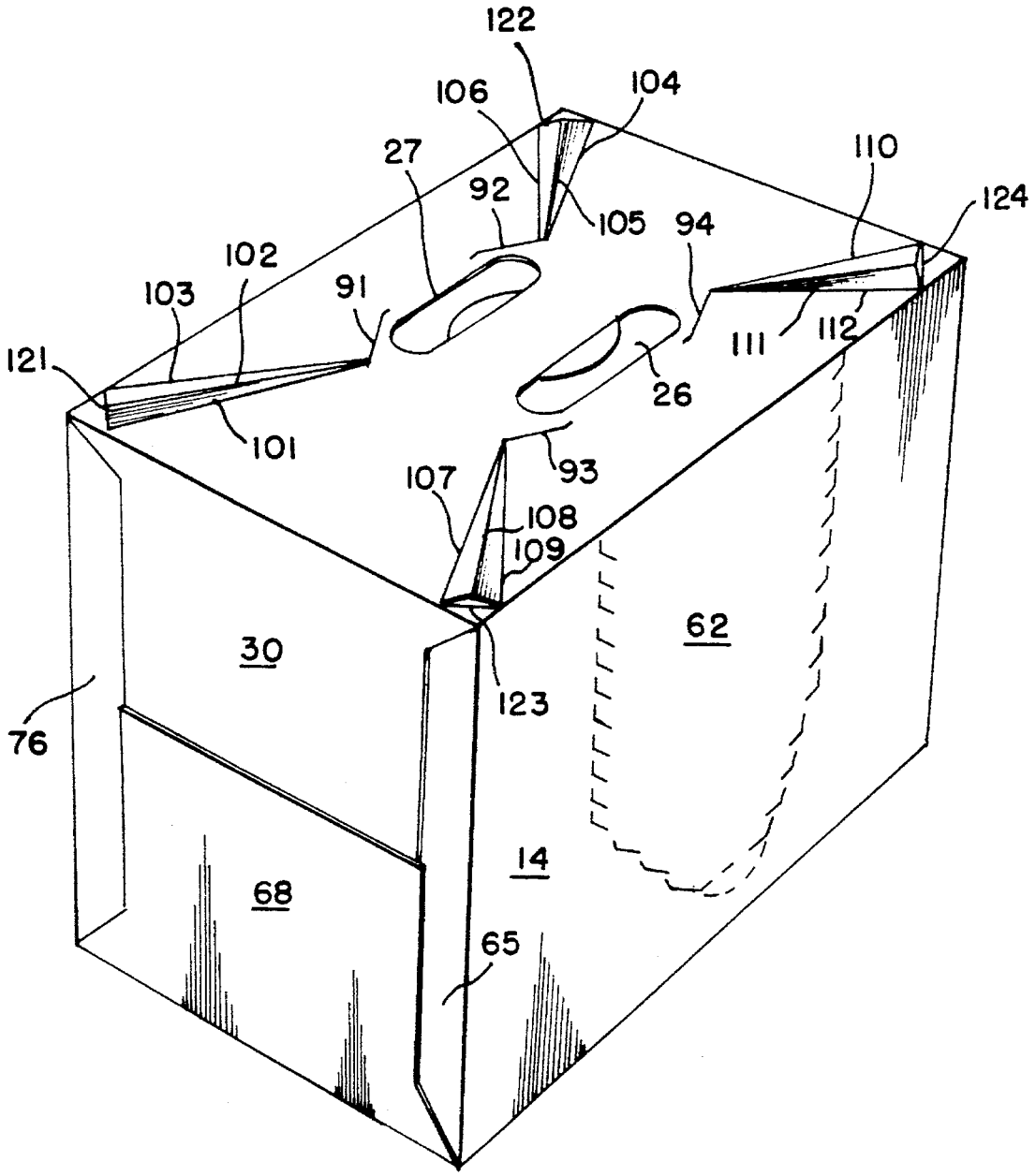
FIG. 3 is a perspective view of the carton formed from the blank in FIG. 1.

The blank of FIG. 1 is manipulated into a tubular structure having open ends by folding the handle reinforcing structure provided by the portions 42, 46, 50 and 52, gluing the glue flap 38 to the side wall panel 22 and folding the wall panels 12, 14, 18 and 22 along the fold lines 16, 20, 24 and 40. Articles such as beverage cans or the like are loaded into the tubular structure through one or both of the open ends, and then the major and minor end flaps 30, 34, 65, 67, 68, 72, 76 and 80 are folded inwardly to close the open ends. Details of the assembly process for the carton may be found by reference to U.S. patent application Ser. No. 08/281,549. The completed carton which has been loaded and sealed is illustrated in FIG. 3 wherein a carrying handle is provided between the handle apertures 26 and 27.

Figure 4:
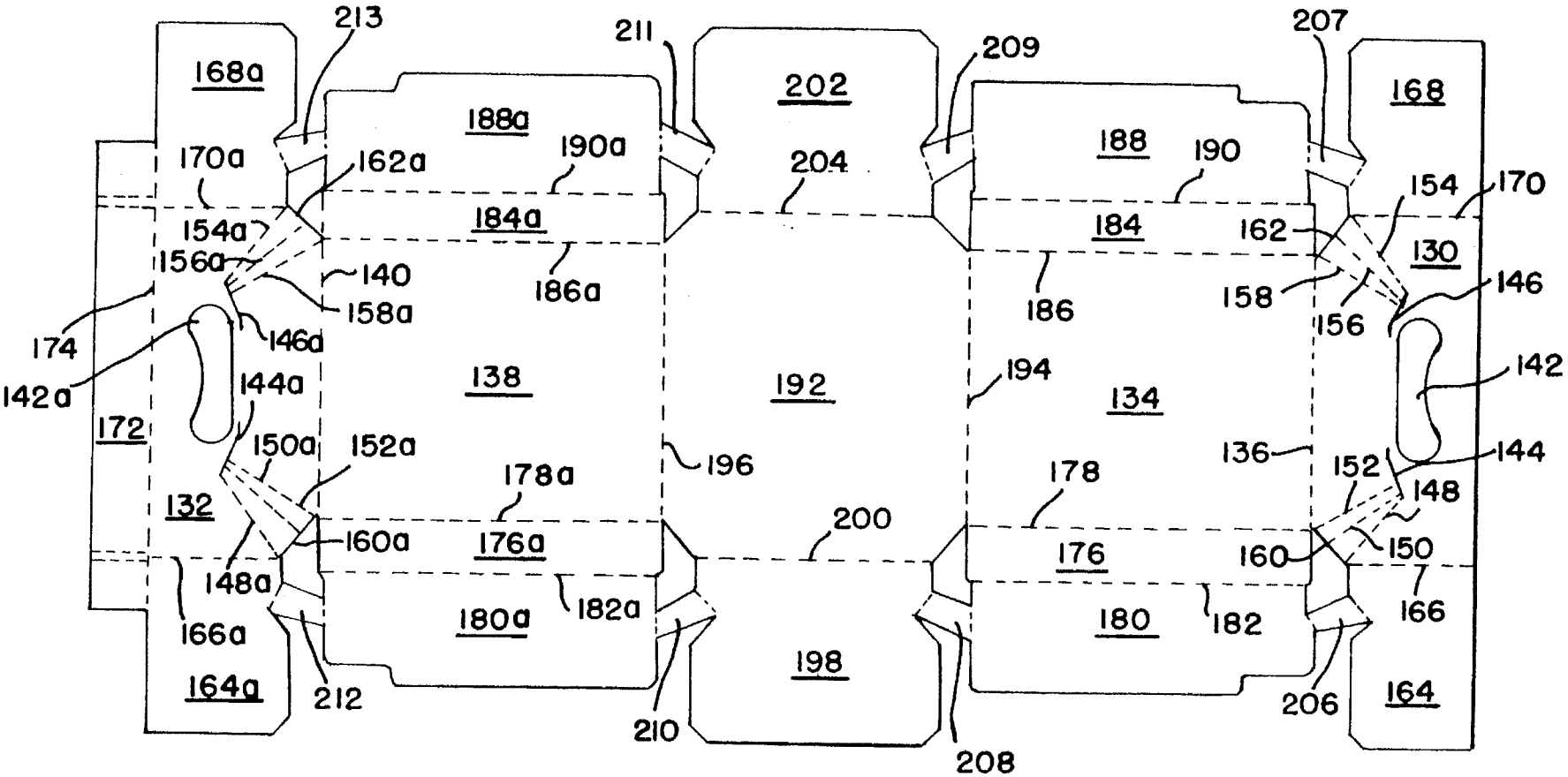
FIG. 4 is a plan view of a blank for forming a carton of another embodiment of the present invention.
Figure 5:
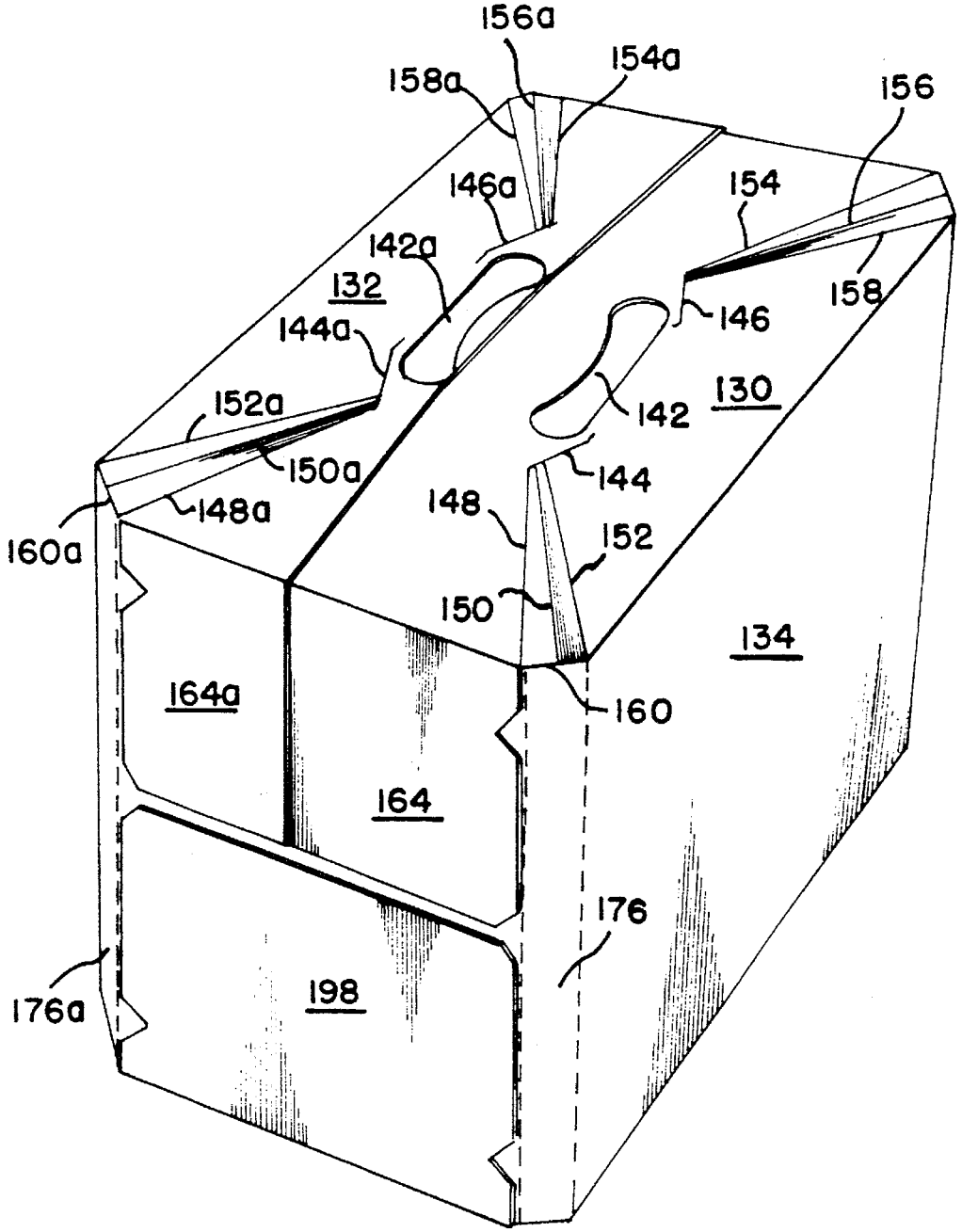
FIG. 5 is a perspective view of the carton formed from the blank in FIG. 4.

FIGS. 4 and 5 illustrate another embodiment of the carton according to the present invention. Unlike the carton shown in FIGS. 1–3, the top wall of the carton is an octagonal composite wall formed by a pair of partial top wall panels 130 and 132 which overlap each other as shown in FIG. 5. The carton, when in blank form, has the partial panels 130 and 132 located at the opposite ends of the blank as shown in FIG. 4.

With respect to FIG. 4, the partial panel 130 is foldably joined to a side wall panel 134 along a fold line 136, and the partial panel 132 is foldably joined to the other side wall panel 138 along a fold line 140.

A hand aperture 142 and a pair of severance lines 144 and 146 are formed in the partial panel 130, and two sets of three reinforcing fold lines 148, 150, 152; and 154, 156, 158 extend respectively from the severance lines 144 and 146 to the bevelled corners 160 and 162 of the partial panel 130. A partial major end flap 164 is joined to the partial panel 130 along a fold line 166, and a partial major end flap 168 is joined to the partial panel 130 along a fold line 170.

The partial panel 132 is identical to the panel 130 in all aspects except that a reinforcing strip 172 is foldably joined to the partial panel 132 along a fold line 174. The numerals used with the partial panel 132 and its associated flaps are duplicates of the numerals used in connection with the partial panel 130 except for the addition of the subscript "a".

A bevelled strip 176 is foldably joined to the side wall panel 134 along a fold line 178, and a minor end flap 180 is foldably joined to the bevelled strip 176 along a fold line 182. A bevelled strip 184 is foldably joined to the side wall panel 134 along a fold line 186, and a minor end flap 188 is foldably joined to the bevelled strip 184 along a fold line 190.

The strips and flaps associated with the side wall panel 138 are identical to those associated with the side wall panel 134 and therefore are indicated by the same numerals accompanied by the subscript "a".

A bottom wall panel 192 is foldably joined at its opposite side edges respectively to the side wall panels 134 and 138 along fold lines 194 and 196. A major end flap 198 is foldably joined to the bottom wall panel 192 along a fold line 200, and a major end flap 202 is foldably joined to the bottom wall panel 192 along a fold line 204. The end flaps of the blank are foldably interconnected by web panels

206–213.

The blank in FIG. 4 is assembled into the carton as shown in FIG. 5 by folding and gluing the blank in a known manner. Details of the assembly process for such a carton may be found by reference to U.S. Pat. No. 5,307,932 which is incorporated herein by reference.

It should be readily recognized that while in the foregoing embodiments, the present invention has been described in connection with top walls having sets of three reinforcing fold lines, the stress-relieving severance lines may also be used with any carton walls having slotted carrying handles. Such carton walls include those having one, two or more than three reinforcing fold lines extending from each inner severance line. In some cases, the reinforcing fold lines may even be eliminated from such a carton wall.

It should be also recognized that the exact shape of the handle apertures may be varied, depending upon product orientation, carton size and the like. In appropriate cases, only a single aperture may be used. What is important is that the handle aperture be associated with inner severance lines which separate the region of the aperture from the regions of the adjacent corners of the respective carton wall.

It will be further recognized that the present invention may be used with a carton for packaging two tiers of cans as well as with a carton for packaging only a single tier of cans, bottles, jars or other primary containers.

What is claimed is:

1. A carton for packaging articles, comprising a plurality of carton walls foldably interconnected to form said carton, one of said carton walls having a pair of opposed side edges, a pair of opposed end edges and a first hand aperture for use in lifting said carton, each of said side edges and either one of said end edges defining therebetween a corner of said one carton wall, said one carton wall being formed with a first severance line disposed transversely of an imaginary line extending between said first hand aperture and one of said corners so as to prevent stress concentration at a region of said first hand aperture upon lifting of said carton, said severance line extending from and terminating in said one carton wall such that opposite ends of said severance line are disposed at positions spaced from said side and end edges.

2. A carton according to claim 1, wherein said one carton wall has a second hand aperture formed therein at a position spaced from said first aperture such that said first and second apertures define therebetween a handle strip, and said severance line is provided at a position between said handle strip and each of said corners of said one carton wall.

3. A carton according to claim 2, wherein said one carton wall has at least one fold line extending from each of said severance lines toward adjacent one of said corners.

4. A carton according to claim 3, wherein a set of fold lines emanate from said each severance line and diverge from each other toward said adjacent corner.

5. A carton according to claim 3, wherein said first and second hand apertures are transversely spaced from each other such that said handle strip extend generally parallel to said side edges.

6. A carton according to claim 5, wherein one of said opposite ends of each of said severance lines is disposed closer to adjacent one of said end edges than the other end of said each severance line, and said at least one fold line emanates from said one end of said each severance line.

7. A carton according to claim 6, wherein a length of said each severance line adjacent to said other end is curved such that said other end is directed toward one of said end edges opposite said adjacent end edge.

8. A carton according to claim 3, wherein said at least one fold line terminates at a location spaced inwardly from said adjacent corner.

9. A carton according to claim 8, wherein said at least one fold line terminates at a second severance line formed in said one carton wall near said adjacent corner, said second severance line extending diagonally between adjacent one of said side edges and adjacent one of said end edges.

10. A carton according to claim 3, wherein said one carton wall is generally octagonal in shape such that bevelled corner edges are provided respectively at said corners, and said at least one fold line terminates at adjacent one of said bevelled corner edges.

11. A carton according to claim 10, wherein a second severance line is formed in said carton along each of said bevelled corner edges.

12. A carton for packaging articles, comprising a generally rectangular top wall having a pair of spaced hand apertures formed therein, said hand apertures being disposed to define therebetween a handle strip for use in lifting said carton, said top wall being provided with a fold line extending from a region of each corner of said top wall toward said handle strip and further with a first severance line extending transversely of each of said fold lines, each of said first severance lines being interposed between said handle strip and respective one of said fold lines such that said respective fold line terminates at said each first severance line, whereby a region of said handle strip is relieved from stress concentration upon lifting of said carton.

13. A carton according to claim 12, wherein said each severance line extends from and terminating in said top wall.

14. A carton according to claim 13, wherein said hand apertures are transversely spaced from each other such that said handle strip extend generally parallel to opposed side edges of said top wall, one of said opposite ends of said each severance line is disposed closer to adjacent one of opposed end edges of said top wall than the other end of said each severance line, and said respective fold line terminates at said one end of said each severance line.

15. A carton according to claim 12, wherein said each fold line emanates from a location spaced inwardly from respective one of said corners.

16. A carton according to claim 15, wherein said each fold line emanates from a second severance line formed in said top wall near said respective corner, said second severance line extending diagonally between adjacent one of opposed side edges of said top wall and adjacent one of opposed end edges of said top wall.

17. A carton according to claim 12, wherein said top wall has bevelled corner edges at said corners, and said each fold line emanates from respective one of said bevelled corner edges.

18. A blank for forming a carton, comprising a plurality of foldably interconnected wall panels, one of said wall panels being generally rectangular in shape and having a hand aperture formed therein, said one wall panel being provided with a fold line extending from a region of one of corners of said one wall panel toward said hand aperture and further with a severance line extending transversely of said foldline, said severance line being interposed between said hand aperture and said fold line such that said fold line terminates at said severance line.

19. A blank according to claim 18, wherein said severance line extends from and terminating in said one wall panel such that opposite ends of said severance line are disposed at positions spaced inwardly from adjacent edges of said one wall panel.

20. A blank according to claim 19, wherein said hand aperture extends generally parallel to opposed side edges of said one wall panel, one of said opposite ends of said severance line is disposed closer to adjacent one of opposed end edges of said one wall panel than the other end of said severance line, and said fold line terminates at said one end of said severance line.

* * * * *